US009127916B2

(12) United States Patent
Greenwood

(10) Patent No.: US 9,127,916 B2
(45) Date of Patent: Sep. 8, 2015

(54) BLANKET PROTECTION SYSTEM

(75) Inventor: Kyle L. Greenwood, College Station, TX (US)

(73) Assignee: Black Mountain Industries, Inc., Bryan, TX (US)

( * ) Notice: Subject to any disclaimer, the term of this patent is extended or adjusted under 35 U.S.C. 154(b) by 0 days.

(21) Appl. No.: 12/790,902

(22) Filed: May 31, 2010

(65) Prior Publication Data

US 2011/0290105 A1 Dec. 1, 2011

(51) Int. Cl.
*F41H 7/04* (2006.01)
*F41H 5/06* (2006.01)

(52) U.S. Cl.
CPC ..... *F41H 7/04* (2013.01)

(58) Field of Classification Search
USPC ..... 89/36.01, 36.04, 36.05, 36.08, 36.02, 89/918, 921; 2/2.5; 102/303
See application file for complete search history.

(56) References Cited

U.S. PATENT DOCUMENTS

| | | | | |
|---|---|---|---|---|
| 1,474,738 | A * | 11/1923 | Thierjung | 5/498 |
| 3,801,416 | A * | 4/1974 | Gulbierz | 109/49.5 |
| 4,316,404 | A * | 2/1982 | Medlin | 89/36.08 |
| 4,590,714 | A * | 5/1986 | Walker | 250/585 |
| 5,377,577 | A * | 1/1995 | Bounkong et al. | 89/36.05 |
| 6,161,462 | A | 12/2000 | Michaelson | |
| 6,175,958 | B1 * | 1/2001 | Wu | 2/2.5 |
| 6,510,777 | B2 | 1/2003 | Neal | |
| 6,696,128 | B2 | 2/2004 | McIntee et al. | |
| 6,786,126 | B2 * | 9/2004 | Sargent | 89/36.02 |
| 6,807,890 | B1 * | 10/2004 | Fuqua | 89/36.02 |
| 7,389,718 | B1 * | 6/2008 | Carter et al. | 89/36.02 |

* cited by examiner

*Primary Examiner* — Reginald Tillman, Jr.
(74) *Attorney, Agent, or Firm* — Tumey L.L.P.

(57) ABSTRACT

A blanket protection system that is adaptable for use in a military vehicle. The blanket protection system includes a blanket comprising a carrier, a ballistic insert, stitch lines, and a plurality of buckles. The portion of the stitch lines extend between at least a portion of the plurality of buckles. In addition, the carrier comprises an interior. Moreover, the ballistic insert is disposed in the interior.

18 Claims, 5 Drawing Sheets

BLANKET PROTECTION SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates to the field of military vehicles and more specifically to the field of blast protection systems for military vehicles.

2. Background of the Invention

There is an increasing need for added protection for occupants of military vehicles. Improvised explosive devices and other methods for attacking military vehicles have drawn added interest in the safety of occupants of military vehicles. Conventional methods for protecting occupants of the vehicles include reliance on the outer minor of the military vehicles. Drawbacks to such conventional methods include instances in which force from the explosive devices enters the interior of the military vehicle, which may place occupants of the military vehicle at severe risk of injury or death.

Methods have been developed to overcome such drawbacks. For instance, reactive armor on the outside of the military vehicle and body armor worn by the occupants of the military vehicle have been developed. Drawbacks to such developments also include risk of injury or death when the explosive forces enter the interior of the military vehicle.

Consequently, there is a need for improved methods for protecting occupants of military vehicles from explosive forces.

BRIEF SUMMARY OF SOME OF THE PREFERRED EMBODIMENTS

These and other needs in the art are addressed in one embodiment by a blanket protection system adaptable for use in a military vehicle. The blanket protection system includes a blanket comprising a carrier, a ballistic insert, stitch lines, and a plurality of buckles. In addition, a portion of the stitch lines extend between at least a portion of the plurality of buckles. The carrier comprises an interior. In addition, the ballistic insert is disposed in the interior.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
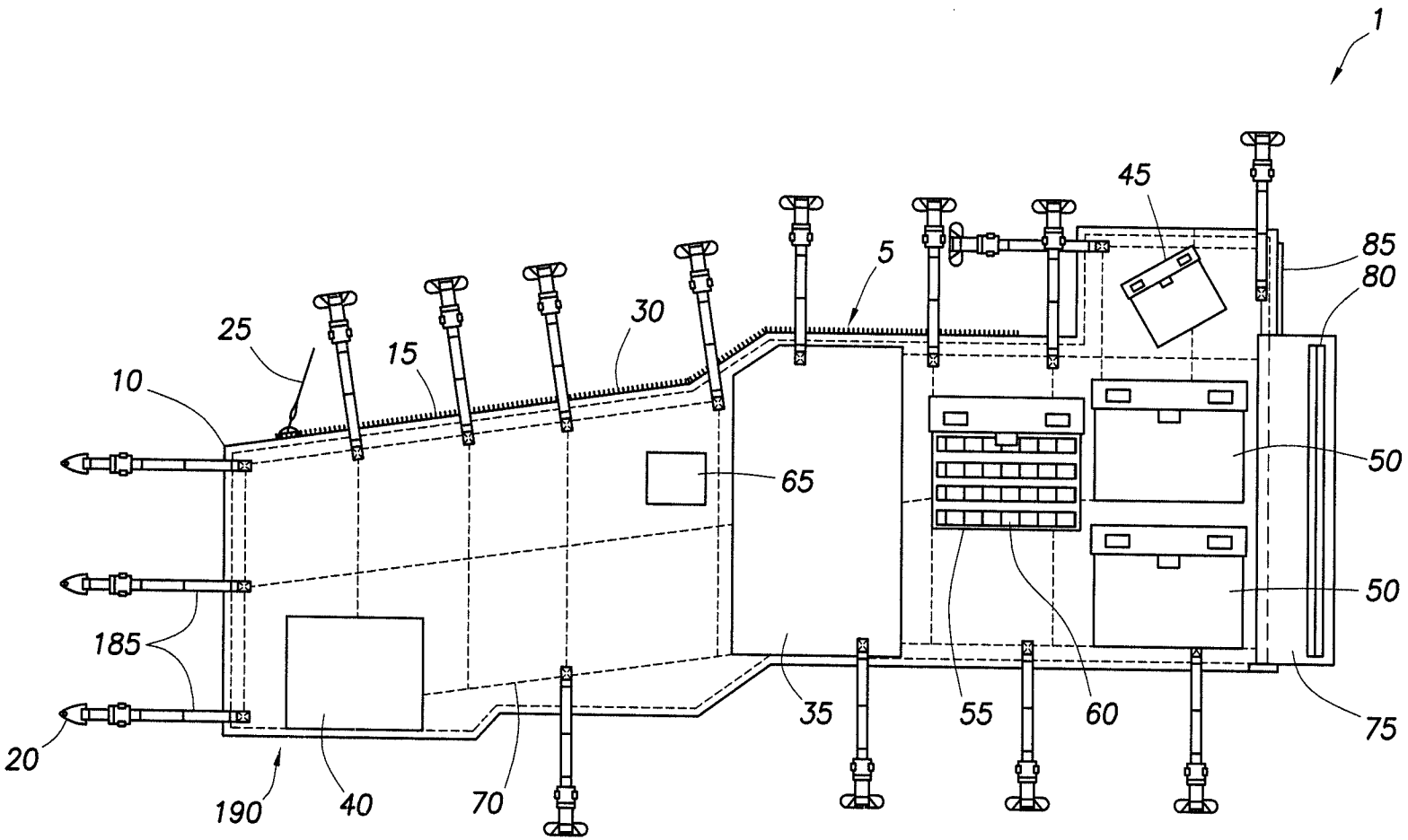
FIG. 1 illustrates a front view of a blanket with a carrier and stitch lines.

FIG. 1 illustrates blanket protection system 1 having blanket 5. FIG. 1 illustrates the front side of blanket 5. Blanket 5 may have any desirable configuration. In an embodiment as illustrated in FIG. 1, blanket 5 has a configuration suitable for placement in the interior of a military vehicle between an occupant of the vehicle and the engine compartment of the vehicle. In some embodiments, the occupant is the driver of the military vehicle. It is to be understood that blanket 5 is not limited to the configuration illustrated in FIG. 1 but includes other configurations in alternative embodiments. For instance, in some alternative embodiments (not illustrated), blanket 5 has a configuration suitable for protecting a desired interior portion of a military vehicle.

Blanket 5 includes carrier 10 and has an interior (not illustrated) in which a ballistic insert 175 (illustrated in FIG. 7) is disposed. Carrier 10 is an outer bag having the interior. Carrier 10 may be composed of any materials suitable for use in a military vehicle. In an embodiment, carrier 10 is composed of flame retardant and/or fluid resistant materials. Without limitation, the flame retardant materials provide further protection against explosive forces. Further, without limitation, the fluid resistant materials protect the interior of carrier 10 and contents therein from fluids. For instance, the fluid resistant materials protect ballistic insert 175 from potential damage from fluids. In some embodiments, carrier 10 is coated with flame retardant and/or fluid resistant materials. The interior of carrier 10 is accessible along top portion 30. In an embodiment, the interior is accessible along any suitable portion of top portion 30 to allow access to the interior and to allow desired inserts such as ballistic insert 175 to be inserted therein. Carrier closure means 15 is operable to open and close access to the interior. Carrier closure means 15 includes any suitable means for closing the access. Examples of carrier closure means 15 include buttons, clamps, a zipper, and the like. In an embodiment, carrier closure means 15 include a zipper. Without limitation, a zipper facilitates a quick and easy method for opening and closing access to the interior. In an embodiment as illustrated in FIG. 1, carrier closure means 15 includes closure means strap 25. In an alternative embodiment, carrier closure means 15 is a means for sealing access to the interior from fluids. In some embodiments, blanket 5 is not openable and closeable. In such an embodiment, ballistic insert 175 is disposed within the interior of blanket 5.

As further shown in FIG. 1, blanket 5 includes buckles 20. Buckles 20 releasably attach blanket 5 to a wall or other structure in the military vehicle. In an embodiment, buckles 20 are quick release buckles. It is to be understood that quick release buckles refer to buckles that are quickly released from attachment to the wall or other structure. Without limitation, quick release buckles allow occupants of the vehicle to quickly attach and quickly release blanket 5 from the vehicle. It is to be understood that in many situations the occupants (soldiers) of the vehicle must release blanket 5 with little effort and time involved. For instance, blanket 5 may provide protection to occupants from the engine compartment of a military vehicle and access to the engine compartment may be needed. Releasing at least a portion of blanket 5 with buckles 20 (quick release buckles) facilitates access to the engine compartment. Buckles 20 may be releasably attached to the military vehicle by any suitable means. In an embodiment, attachment buckles (not illustrated) are secured to the military vehicle, and buckles 20 are releasably attached to the attachment buckles. The attachment buckles may be secured to the military vehicle by any suitable means. In an embodiment, the attachment buckles are secured to the military by adhesive. Without limitation, a commercial example of a suitable adhesive is CB200, which is commercially available from Click Bond, Inc. Buckles 20 include straps 185, which are attachable to blanket 5. Straps 185 may be composed of any materials suitable for use in a military vehicle. In an embodiment, straps 185 include flame resistant materials. Without limitation, the flame resistant materials facilitate straps 185 in maintaining attachment of blanket 5 to the military vehicle when exposed to extreme heat, such as in an explosion. An example of a suitable commercial example of a flame resistant material is KEVLAR, which is commercially available from E. I. du Pont de Nemours and Company. Blanket 5 may include any number of buckles 20 suitable for releasably attaching blanket 5 to the military vehicle.

Figure 6:
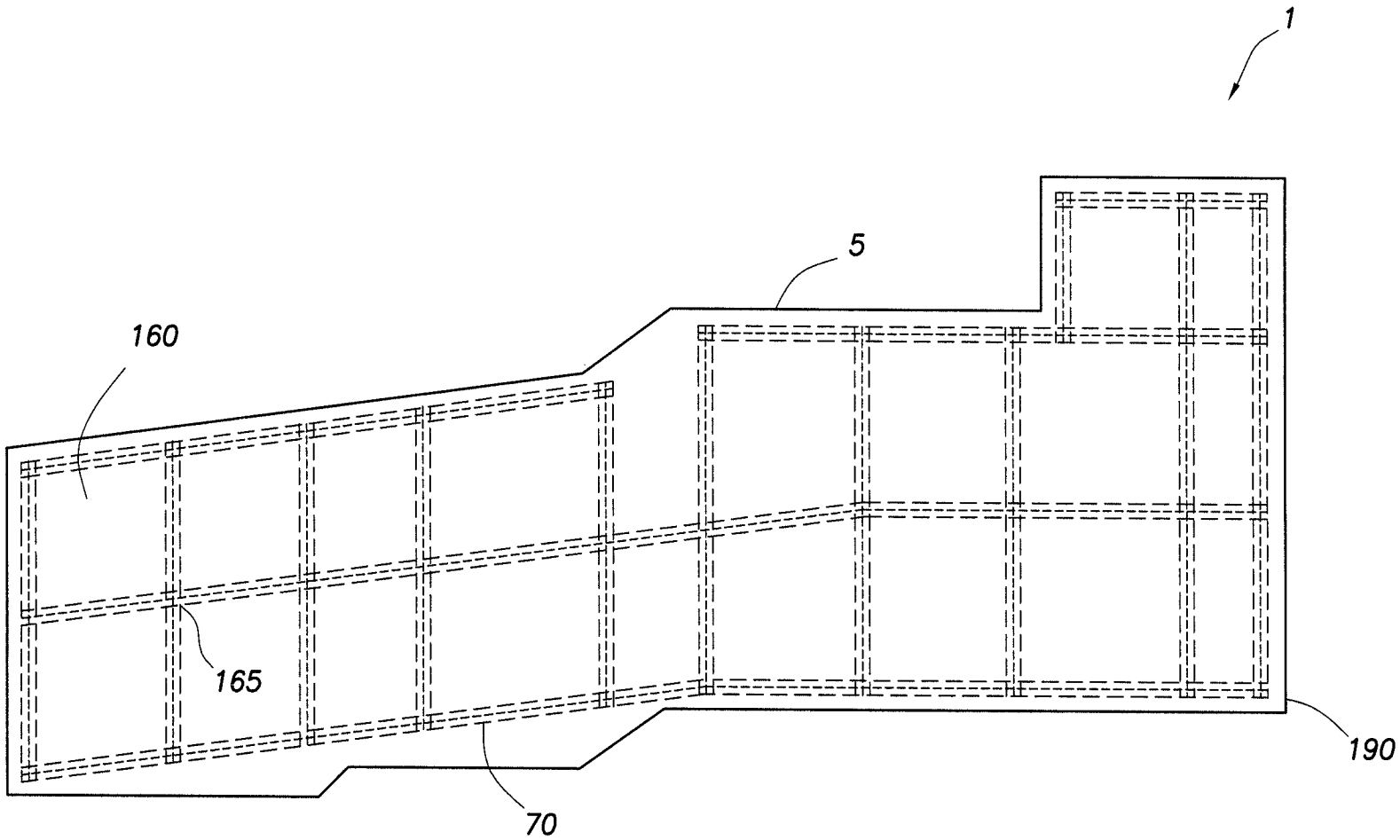
FIG. 6 illustrates the front interior side of the blanket of FIG. 1 showing the stitch lines.

FIG. 1 illustrates an embodiment of blanket 5 in which carrier 10 include stitch lines 70. In the embodiment as shown, stitch lines 70 extend from a strap 185 to each proximate strap 185 and also extend in the direction of the side of blanket 5 opposing the particular strap 185. In some embodiments as illustrated in FIG. 1, a portion of the straps 185 have stitch lines 70 that extend to a strap 185 on an opposing side of blanket 5. Without limitation, stitch lines 70 provide blanket 5 with added strength when exposed to explosion. For instance, stitch lines 70 extending between straps 185 increase the strength in which straps 185 are attached to blanket 5 and thereby facilitate straps 185 remaining attached to blanket 5 when exposed to forces from an explosion. In an embodiment, stitch lines 70 are sewn into carrier 10 on the interior of carrier 10. FIG. 6 illustrates a view of an embodiment of the interior of front side of carrier 10. As shown, stitch lines 70 provide cross-stitching 165. Cross-stitching 165 refers to locations where stitch lines 70 cross each other. Without limitation, cross-stitching 165 provides further strength to carrier 10 by providing enhanced areas of stitching. Stitch lines 70 may be composed of any material suitable for use as a stitching material. In an embodiment, stitch lines 70 include flame resistant materials. In some embodiments, carrier 10 includes reinforcement means 160. Reinforcement means 160 are sewn into carrier 10 by stitch lines 70. Reinforcement means 160 may be any suitable material for improving protection against a blast. For instance, reinforcement means 160 provide added strength and further protection against blast fragments contacting carrier 10. In an embodiment, reinforcement means 160 include a fabric. In some embodiments, reinforcement means 160 include nylon fabric. In an embodiment, reinforcement means 160 are in the form of a web.

In an embodiment as illustrated in FIG. 1, blanket 5 includes pockets. Blanket 5 may include any suitable number and type of pockets. In the embodiment as illustrated, blanket 5 includes flashlight pocket 45, pockets 50, and molle strip pocket 55. Flashlight pocket 45 is a pocket suitable for a flashlight. As shown, in some embodiments, flashlight pocket 45 is angled to facilitate retrieval and placement of a flashlight in flashlight pocket 45. Pockets 50 may be any type of pocket suitable for use in a military vehicle. Molle strip pocket 55 is a pocket with molle strips 60 disposed on an outer portion of molle strip pocket 55. Molle strip pocket 55 may contain any suitable number of molle strips 60.

In some embodiments, blanket 5 also includes protection panels. In an embodiment as illustrated in FIG. 1, blanket 5 includes protection panel 35, protection panel 40, and protection panel 65. Protection panels may be composed of any material suitable for protecting blanket 5 against wear. In an embodiment, the protection panels are leather. The protection panels may be placed at any desirable location on blanket 5. In some embodiments, protection panels are placed at locations in which wear is desired to be protected against. For instance, the protection panels are placed in high contact areas of blanket 5.

In an embodiment as illustrated in FIG. 1, blanket 5 also includes blanket connection means 85 and connection flap 75. Blanket connection means 85 include any means for releasably connecting blanket 5 to another blanket such as second blanket 90 (illustrated in FIG. 2). Examples of blanket connection means 85 include buttons, clamps, a zipper, and the like. In the embodiment illustrated in FIG. 1, blanket connection means 85 include a zipper. Connection flap 75 includes flap connection means 80. Flap connection means 80 includes any means for releasably connecting blanket 5 to another blanket such as second blanket 90. Examples of flap connection means 85 include buttons, clamps, a zipper, VELCRO (commercially available from Velcro Industries B.V.), and the like. Flap connection means 85 provide protection against contact and wear to blanket connection means 85.

Figure 2:
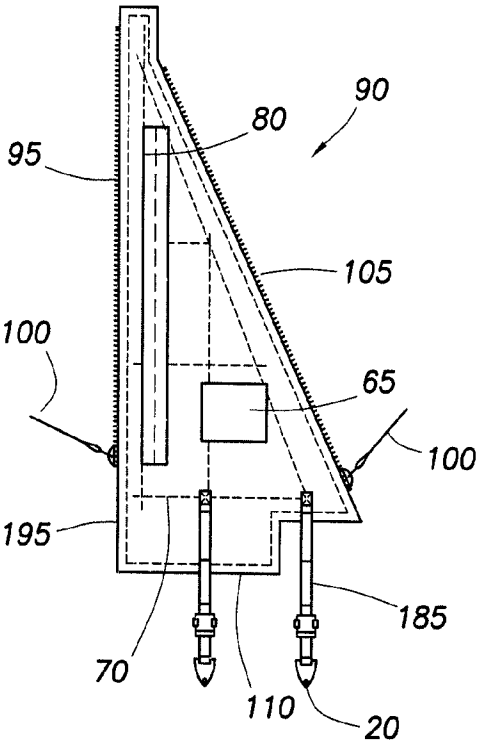
FIG. 2 illustrates a second blanket of the blanket protection system having stitch lines.

FIG. 2 illustrates a view of front side 195 of second blanket 90. Second blanket 90 includes second blanket carrier 110. Second blanket carrier 110 may be composed of any materials suitable for use in a military vehicle. In an embodiment, second blanket carrier 110 is composed of flame retardant and/or fluid resistant materials. Without limitation, the flame retardant materials provide further protection against explosive forces. Further, without limitation, the fluid resistant materials protect the interior of second blanket carrier 110 and contents therein from fluids. For instance, the fluid resistant materials protect ballistic insert 175 from potential damage from fluids. In some embodiments, second blanket carrier 10 is coated with flame retardant and/or fluid resistant materials.

In some embodiments, blanket protection system 1 includes blanket 5 and second blanket 90, with blanket 5 and second blanket 90 releasably attached to each other by blanket connection means 85 and first blanket connection means 95 and/or flap connection means 80. First blanket connection means 95 may include any means suitable for releasably attaching second blanket 90 to another blanket such as blanket 5. Examples of first blanket connection means 95 include buttons, clamps, a zipper, and the like. In the embodiment illustrated in FIG. 2, first blanket connection means 95 is a zipper. In an embodiment, first blanket connection means 95 include connection means strap 100. Second blanket 90 may have any configuration suitable for a desired location in a military vehicle. In an embodiment, second blanket 90 is disposed over a radio access panel of a military vehicle. In some embodiments, blanket protection system 1 includes first blanket 5 releasably attached to second blanket 90 with first blanket 5 having a configuration suitable for providing protection against an explosion coming from the engine room of the military vehicle, and second blanket 90 having a configuration suitable for providing protection against an explosion coming from a radio access panel of the military vehicle. Second blanket 90 includes buckles 20 with straps 185 for releasably attaching second blanket 90 to the military vehicle. Second blanket 90 may also include protection panels 65 or any other protection panels. In an embodiment, a ballistic insert 175 is disposed in an interior of second blanket 90. In an embodiment as illustrated, second blanket 90 is not openable and closeable but instead has a closed interior with ballistic insert 175 disposed therein. In alternative embodiments (not illustrated), second blanket 90 is openable and closeable.

Figure 3:
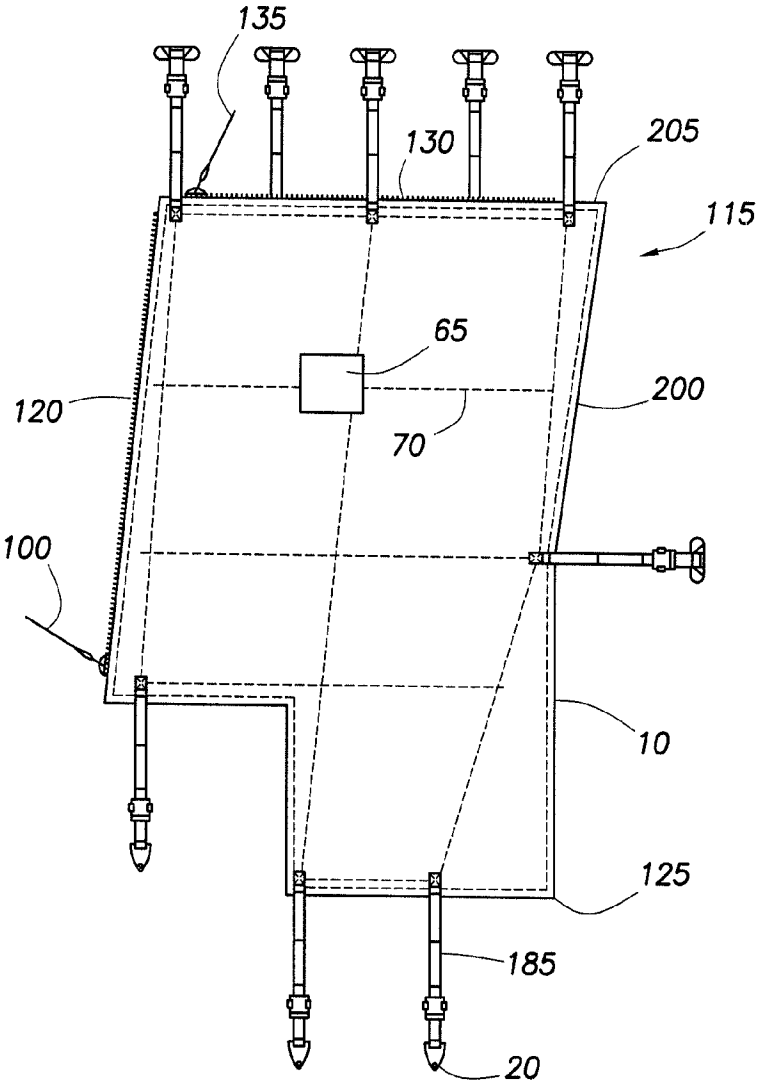
FIG. 3 illustrates a third blanket of the blanket protection system having stitch lines.

In some embodiments, blanket protection system 1 includes blanket 5 releasably attached to second blanket 90, and second blanket 90 releasably attached to another blanket such as third blanket 115 (illustrated in FIG. 3). In such embodiments, second blanket 90 includes second blanket connection means 105, which is suitable for attachment of second blanket 90 to third blanket 115. Examples of second blanket connection means 105 include buttons, clamps, a zipper, and the like. In the embodiment illustrated in FIG. 2, second blanket connection means 105 are a zipper. In an embodiment, second blanket connection means 105 include connection means strap 100.

FIG. 3 illustrates a view of front side 200 of third blanket 115. Third blanket 110 also includes a carrier 10 that is openable and closeable. Third blanket 115 includes third blanket connection means 120. Third blanket connection means 120 include any means suitable for releasably attaching third blanket 115 to another blanket such as second blanket 90. Examples of third blanket connection means 120 include buttons, clamps, a zipper, and the like. In the embodiment illustrated in FIG. 3, third blanket connection means 120 is a zipper. In an embodiment, third blanket connection means 120 includes connection means strap 100. Third blanket 115 may have any configuration suitable for a desired location in a military vehicle. In an embodiment, third blanket 115 is disposed over the dog house of a military vehicle. It is to be understood that the dog house refers to the personnel carrier portion of the vehicle. In some embodiments, blanket protection system 1 includes first blanket 5 releasably attached to second blanket 90 and with second blanket releasably attached to third blanket 115. In such embodiments, first blanket 5 may have a configuration suitable for providing protection against an explosion coming from the engine room of the military vehicle, second blanket 90 may have a configuration suitable for providing protection against an explosion coming from a radio access panel of the military vehicle, and third blanket 115 may have a configuration suitable for providing protection against an explosion coming from the dog house of the military vehicle. Third blanket 115 includes buckles 20 with straps 185 for releasably attaching third blanket 115 to the military vehicle. Third blanket 115 may also include protection panels 65 or any other protection panels. In an embodiment, a ballistic insert 175 is disposed in an interior of third blanket 115.

In an embodiment as illustrated in FIG. 3, third blanket 115 is openable and closeable. The interior of third blanket 115 is accessible along top portion 205. In an embodiment, the interior is accessible along any suitable portion of top portion 205 to allow access to the interior and to allow desired inserts such as ballistic insert 175 to be inserted therein. Third blanket 115 also includes third blanket carrier closure means 130. Third blanket carrier closure means 130 is operable to open and close access to the interior. Third blanket carrier closure means 130 include any suitable means for closing the access. Examples of third blanket carrier closure means 130 include buttons, clamps, a zipper, and the like. In an embodiment, third blanket carrier closure means 130 include a zipper. In an embodiment as illustrated in FIG. 3, third blanket carrier closure means 130 include closure means strap 135. In an alternative embodiment, third blanket carrier closure means 130 is a means for sealing access to the interior from fluids. In some embodiments, third blanket 115 is not openable and closeable. In such an embodiment, ballistic insert 175 is disposed within the interior of third blanket 115.

Figure 4:
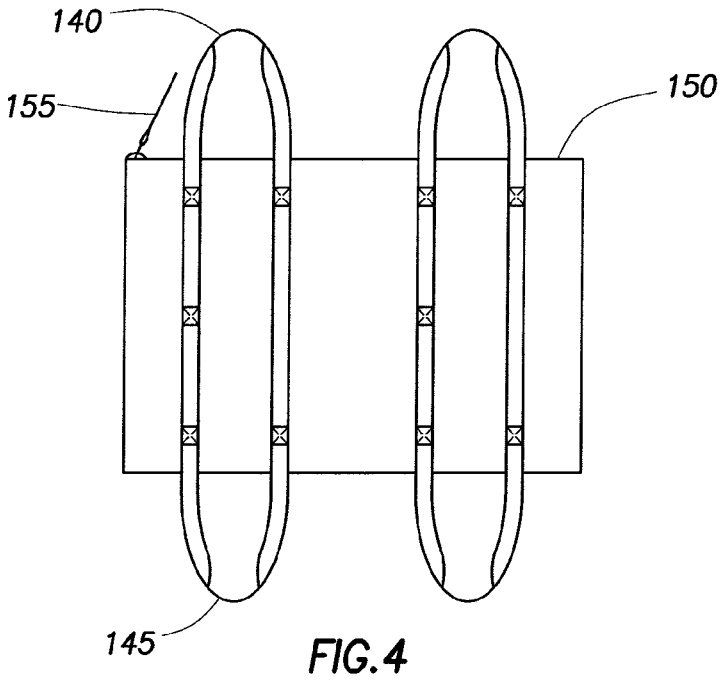
FIG. 4 illustrates a storage unit.

FIG. 4 illustrates an embodiment of blanket protection system 1 including storage unit 140. Storage unit 140 may include any configuration suitable for storing the blankets (i.e., blanket 5, second blanket 90 and/or third blanket 115). In an embodiment as illustrated, storage unit 140 allows blanket protection system 1 to be stored and transported. The blankets may be stored in the interior of storage unit 140. In an embodiment, storage unit 140 includes carrier straps 145, which facilitate transportation of storage unit 140. In some embodiments, carrier straps 145 are suitable for allowing storage unit 140 to be transported on the back of a carrier (i.e., soldier). In some embodiments, storage unit 140 may be openable and closeable. In such embodiments, closure means 150 are operable to open and close access to the interior. Closure means 150 include any suitable means for closing the access. Examples of closure means 150 include buttons, clamps, a zipper, and the like. In an embodiment, closure means 150 include a zipper. In an embodiment as illustrated in FIG. 4, closure means 150 include closure strap 155.

Figure 5:
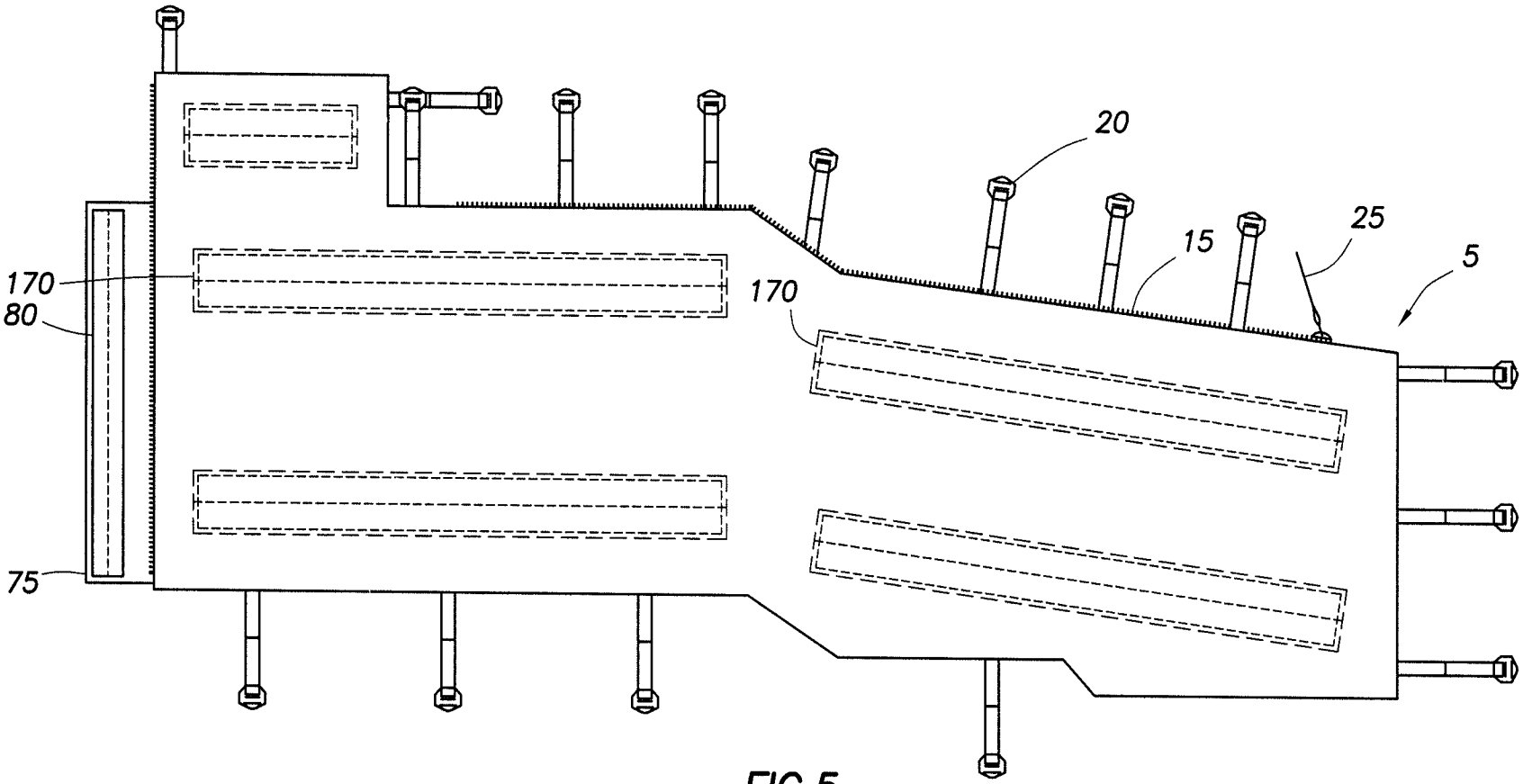
FIG. 5 illustrates the front interior side of the blanket of FIG. 1.

FIG. 5 illustrates a view of the interior of front side of blanket 5. In such an embodiment, blanket 5 includes ballistic connection means 170. Ballistic connection means 170 include any means suitable for attaching ballistic insert 175 to carrier 10. For instance, examples of suitable ballistic connection means 170 include buttons, clamps, a zipper, VELCRO, and the like. It is to be understood that embodiments of second blanket 90 and third blanket 115 also include ballistic connection means 170.

Figure 7:
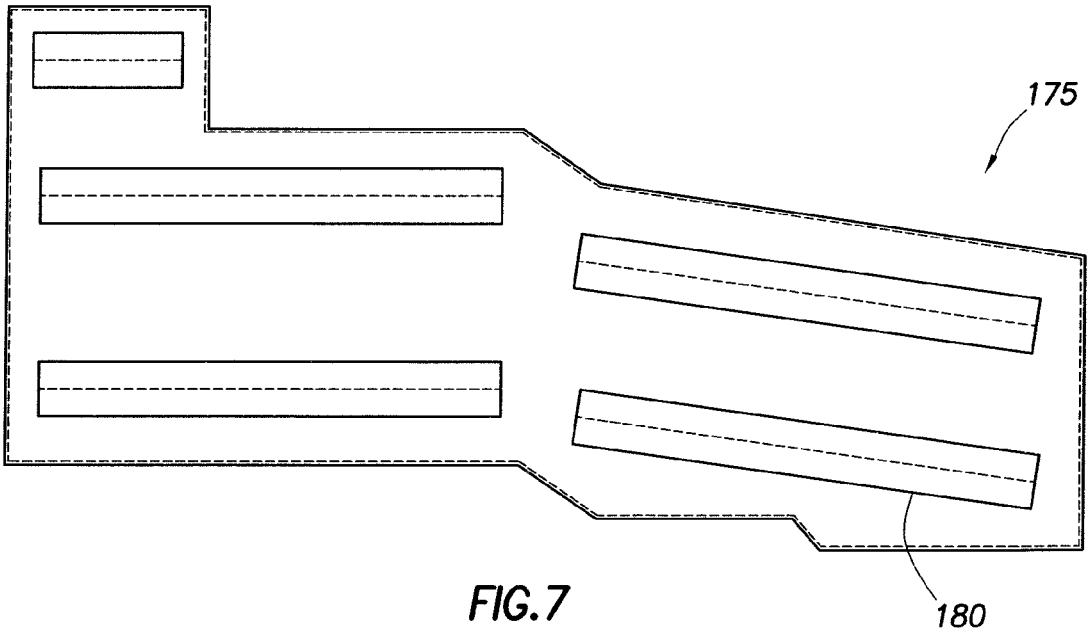
FIG. 7 illustrates the ballistic insert for the blanket of FIG. 1.

FIG. 7 illustrates an embodiment of ballistic insert 175. Ballistic insert 175 includes any materials suitable for stopping or reducing the velocity of projectiles. In an embodiment, ballistic inset 175 includes aramid fibers. A commercial example of suitable materials includes KEVLAR. In an embodiment, ballistic insert 175 is coated and/or covered in a fluid resistant material. Ballistic insert 175 may have any suitable configuration. In an embodiment, ballistic insert 175 has a configuration that is similar to that of the blanket in which it is disposed. Without limitation, such an embodiment improves the protection capability of the blanket as the similar configuration of ballistic inert 175 maximizes protection within the configuration of the blanket. It is to be understood that the configuration of the embodiment of ballistic insert 175 illustrated in FIG. 1 is suitable for blanket 5. In some embodiments, ballistic insert 175 includes ballistic insert connection means 180. Ballistic insert connection means 180 include any suitable means for attaching ballistic insert 175 to a blanket (i.e., by attachment with ballistic connection means 170). For instance, examples of suitable ballistic insert connection means 180 include buttons, clamps, a zipper, VELCRO, and the like. It is to be understood that ballistic insert 175 is not limited to ballistic insert connection means 180 but instead may be attached to a blanket by any suitable means. In embodiments, ballistic insert 175 is attached to a blanket (i.e., such as blanket 5, second blanket 90, and/or third blanket 115) by being sewn to a blanket.

The military vehicle may be any type of military vehicle. In some embodiments, the military vehicle is an armored personnel carrier. In an embodiment, the military vehicle is a LAV-25, which is commercially available from General Dynamics. In an embodiment, blanket protection system 1 provides protection to the driver of the military vehicle.

It is to be understood that blanket protection system 1 is not limited to blanket 5, second blanket 90, and/or third blanket 115. In alternative embodiments, blanket protection system 1 may include at least one additional blanket.

Although the present invention and its advantages have been described in detail, it should be understood that various changes, substitutions and alterations may be made herein without departing from the spirit and scope of the invention as defined by the appended claims.

What is claimed is:

1. A blanket protection system for a military vehicle, comprising:

a blanket comprising a carrier with a carrier closure means, a removable ballistic insert, a plurality of buckles, and a plurality of attachment buckles;

wherein the carrier closure means is a zipper;

wherein the buckles are quick release buckles;

a connection flap, wherein the connection flap connects to a second blanket with hook and loop fasteners, wherein the connection flap covers a connection means attaching the blanket and the second blanket, wherein the connection means is a zipper:

a stitch line extending from a buckle on a side of the carrier to a proximate buckle on the side, and another stitch line extending from the buckle to an opposing buckle on an opposing side of the carrier;

wherein the carrier comprises an interior, and wherein the interior is closeable by the carrier closure means;

wherein a set of stitch lines are cross stitched into the interior of the carrier to provide the blanket additional strength when exposed to an explosion;

wherein the ballistic insert is disposed in the interior;

wherein the ballistic insert is secured to the interior by a ballistic connection means; and wherein the blanket is capable of attachment to an interior wall of the military vehicle.

2. The blanket protection system of claim 1, wherein the carrier comprises a flame retardant material.

3. The blanket protection system of claim 1, wherein the carrier comprises a fluid resistant material.

4. The blanket protection system of claim 1, wherein each buckle comprises a strap, and wherein an end of the strap opposing the buckle is attached to the carrier.

5. The blanket protection system of claim 4, wherein the stitch line extends from the end of the strap of the buckle to the end of the strap of the proximate buckle.

6. The blanket protection system of claim 5, wherein the another stitch line extends from the end of the strap of the buckle to the end of the strap of the buckle on the opposing side of the carrier.

7. The blanket protection system of claim 1, further comprising a cross-stitching.

8. The blanket protection system of claim 7, wherein the cross-stitching comprises a location on the carrier where at least two stitch lines cross each other when extending between buckles.

9. The blanket protection system of claim 1, further comprising reinforcement means, wherein the reinforcement means are disposed between stitch lines.

10. The blanket protection system of claim 9, wherein the reinforcement means comprise nylon fabric.

11. The blanket protection system of claim 1, wherein the plurality of buckles are adapted to releasably attach the blanket to the military vehicle.

12. The blanket protection system of claim 1, wherein the blanket comprises a center, wherein the carrier comprises a plurality of protection panels and wherein the protection panels are located at or about the center of the blanket.

13. The blanket protection system of claim 1, wherein the carrier comprises a plurality of pockets on an exterior of the carrier and wherein the pockets have a plurality of MOLLE strips.

14. The blanket protection system of claim 1, wherein the second blanket is releasably attached to the blanket, and wherein the second blanket comprises a second ballistic insert.

15. The blanket protection system of claim 14, further comprising a third blanket, wherein the third blanket is releasably attached to the second blanket, and wherein the third blanket comprises a third ballistic insert.

16. The blanket protection system of claim 1, wherein the blanket protection system is adaptable for releasable attachment to the military vehicle.

17. The blanket protection system of claim 1, wherein the carrier is openable and closeable along a top portion of the carrier.

18. A blanket protection system for a military vehicle, comprising:

a blanket comprising a carrier with a carrier closure means, a removable ballistic insert, a plurality of quick release buckles, a plurality of attachment buckles, a plurality of protection panels, a plurality of pockets, and a plurality of reinforcement means;

wherein the carrier closure means is a zipper;

wherein there are at least three protection panels, wherein the protection panels are leather, and further wherein the protection panels are stitched at or about a center of the blanket;

wherein the pockets have a plurality of MOLLE strips;

wherein the reinforcement means are stitched to a front and a back of the blanket, and further wherein the reinforcement means are made of nylon fabric;

a stitch line extending from a quick release buckle on a side of the carrier to a proximate quick release buckle on the side, and another stitch line extending from the quick release buckle to an opposing quick release buckle on an opposing side of the carrier;

wherein the carrier comprises an interior;

wherein a set of stitch lines are cross stitched into the interior of the carrier;

wherein the ballistic insert is disposed in the interior;

wherein the ballistic insert is secured to the interior by a ballistic connection means;

wherein the ballistic connection means is a hook and loop fastener;

wherein the blanket is capable of attachment to an interior wall of the military vehicle;

wherein the blanket further comprises a blanket connection means and a connection flap, and wherein the blanket connection means comprises a zipper, and further wherein the blanket connection means and the connection flap releasably connect the blanket to another blanket;

a storage unit, wherein the blanket is disposable in the storage unit; and wherein the storage unit has a plurality of carrier straps.

* * * * *